United States Patent [19]

Nelson

[11] Patent Number: 4,860,728

[45] Date of Patent: Aug. 29, 1989

[54] WATER HEATER DEVICE

[76] Inventor: Thomas E. Nelson, 2407 Greten La., Anchorage, Ky. 40223

[21] Appl. No.: 313,480

[22] Filed: Feb. 22, 1989

Related U.S. Application Data

[63] Continuation-in-part of Ser. No. 177,393, Apr. 4, 1988.

[51] Int. Cl.[4] ..... F24H 1/00

[52] U.S. Cl. ..... 126/361; 122/13 R; 122/494

[58] Field of Search ..... 126/361; 122/13 R, 13 A, 122/14, 17, 494

[56] References Cited

U.S. PATENT DOCUMENTS

| | | | |
|---|---|---|---|
| 1,996,625 | 4/1935 | Pendleton | 122/13 A |
| 4,372,028 | 2/1983 | Clark et al. . | |
| 4,447,377 | 5/1984 | Denton . | |
| 4,477,399 | 10/1984 | Tilton . | |

*Primary Examiner*—Carroll B. Dority, Jr.
*Attorney, Agent, or Firm*—Woodard, Emhardt, Naughton, Moriarty & McNett

[57] ABSTRACT

A water heater device including an inner tank for containing water surrounded in spaced-apart relationship by an outer shell. The top end of the water heater device is closed by a cap, and the bottom end of the water heater construction is closed by a floor connected to the outer shell. The inner tank has a concave bottom wall. An enclosed, flexible collar filled thermal insulation material, such as fiberglass, is arranged into two pouches wherein the outer pouch is located in the annular space between the inner tank and outer shell proximate the bottom end of the water heater device concentric with the annular space such that the collar is in contact with the interior wall surface of the outer shell and in contact with the exterior wall surface of the inner tank. The inner pouch which is disc-shaped is disposed beneath the tank.

1 Claim, 3 Drawing Sheets

WATER HEATER DEVICE

This application is a continuation-in-part patent application of my prior copending application Ser. No. 177,393 filed Apr. 4, 1988 pending.

BACKGROUND OF THE INVENTION

The present invention relates to water heater devices and more particularly to a thermally insulated water heater device. It is becoming more important to improve the insulation of hot water heaters to conserve energy, and the present invention is directed to improved insulation concepts.

Typically, water heater devices are constructed of an inner water tank with an outer shell located concentrically over the inner tank defining an annular space therebetween, a cap closing the top end of the water heater device, and a floor closing the bottom end of the water heater device. The space between the inner tank and outer shell is filled with a thermal insulation. For many years fiberglass mats have been used as the insulation material between the inner tank and outer shell. More recently a foam, such as urethane, has been used as the thermal insulation material in place of fiberglass between the inner tank and outer shell. Typically, a foamable material is injected into the annular space between the inner tank and outer shell, and is allowed to foam in situ. However, there is a problem in restraining the expanding foam within the annular space and more particularly within a predetermined location or region within the annular space. Further, it is a problem during manufacture of the water heater device to insulate the bottom end of the water tank. Various proposals have been made to solve this problem.

U.S. Pat. No. 4,372,028; issued on Feb. 8, 1983 to Clark et al. shows a water heater having a foam-filled closed bag located in the annular space between the inner tank and outer shell at the bottom of the inner tank, with the annular space above the annular bag filled with expanded foam. The collar functions as a stop to the expanded foam in the annular space thereabove. In the manufacture of the water heater a fleible, expandable closed elongated bag having a hole therein is filled with a foam material which expands the bag, and before the foam material has had sufficient time to fully expand, the bag opening is sealed and the bag is circumferentially wrapped around the lower end of the tank with the bag ends overlapping each other. Still, before the foam material in the bag has had sufficient time to expand, the outer shell is positioned over the inner tank and bag. The foam in the bag expands to a size so as to be in compression between the inner tank and outer shell. The annular space above the collar is then filled with expandable foam material.

U.S. Pat. No. 4,447,377 issued on May 8, 1977 to Denton shows a gas-fired water heater wherein a layer of fiberglass batt insulation material is wrapped around the bottom portion of the inner water tank around the combustion chamber and a plastic envelope is wrapped around the inner tank above the fiberglass insulation. The envelope is in the form of an elongated thin tube having an inner wall, an outer wall, a bottom wall, two end walls and an open top. When wrapped around the inner tank, the end walls of the envelope abut each other. The outer shell is positioned over the inner tank such that the envelope is in the annular space therebetween. Expandable foam is injected through the open envelope top into the envelope and allowed to expand therein. The fiberglass batt does not form a seal between itself and the inner water tank and the outer shell.

U.S. Pat. No. 4,477,399 issued on Oct. 16, 1984 to Tilton shows a water heater having an inflatable toroidally shaped tube located around the bottom end of the inner tank such that when the toroidal tube is inflated with air, it seals the bottom end of the annular space between the inner tank and outer shell. A foamable material is then injected into the annular space above the toroidal tube to fill the annular space.

It is also known to position a layer of insulation batting, such as a layer of fiberglass batt, over the bottom end of the water tank.

Each of the above-discussed water heater constructions present numerous problems in manufacture such as, for example, a large number of steps, critically timed steps, and time-consuming steps which add to the cost and present potential for defects in the final product.

SUMMARY OF THE INVENTION

A water heater device according to a typical embodiment of the present invention includes a water tank, an outer shell concentrically located over the water tank and defining an annular clearance space therebetween and a thermal insulating member including a pliable material envelope which is filled with loose, discrete insulation material, said envelope being arranged into a disc-shaped portion disposed beneath the bottom end of the water tank and connected thereto an annular collar portion disposed around the water tank and positioned within the annular clearance space, the collar having a radial thickness greater than the radial width of the annular clearance space such that the collar is radially compressed between the shell and the tank.

One object of the present invention is to provide an improved water heater construction.

Related objects and advantages of the present invention will be apparent from the following description.

DESCRIPTION OF THE PREFERRED EMBODIMENT

Figure 1:
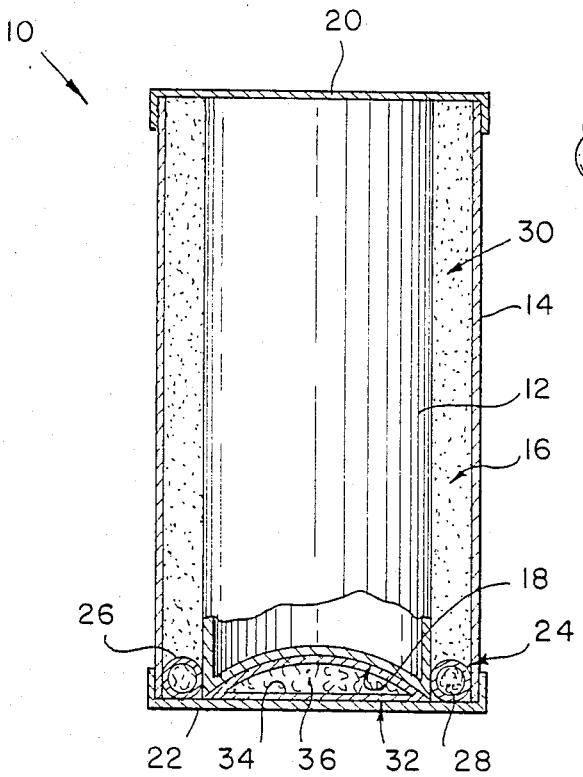
FIG. 1 is a longitudinal cross-sectional view of a water heater device according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 schematically illustrates, in longitudinal cross section, a water heater device generally denoted by reference numeral 10, having a generally cylindrical inner water tank 12 for containing water and a generally cylindrical outer shell 14 concentrically surrounding the inner water tank 12. The outer shell 14 is of a larger diameter than the water tank 12 and they cooperate to define an annular space 16 therebetween. As illustrated, the water heater device 10 is of the electrically heated type having, for example, an electrical resistance unit (not shown) projecting into the interior of the water tank 12 to heat the water therein. The bottom end of the inner water tank 12 is formed with a concavity 18. The top end of the water heater device 12 is closed by a cap 20, which may be a separate component or may be unitary with the outer shell 14. The bottom end of the water heater device 10 is typically closed by a floor 22.

With further reference to FIG. 1, an insulating thermal collar 24 is located in the annular space 16. The collar 24 includes an enclosing envelope 26 filled with a thermal insulation material 28. The enclosing envelope 26 is fabricated of a fluid impermeable, pliable material such as, for example, polyethylene film, vinyl film, metalized polyester, metal foil, and the like. The thermal insulation material 28 can be a fibrous batt,, such as interwoven fiberglass, or a loose, discrete, divided material, such as for example noninterengaged fiberglass, mineral wool, steel wool, cellulose, ceramic fiber, discrete particles or beads of plastic foam, and the like. It is contemplated that in some applications it may be necessary to cohesively hold the loose, discrete, divided insulation material together inside the envelope 26 to prevent the insulation material from shifting or settling within the enclosing envelope 26. In this event, a binder material is homogeneously dispersed throughout the mass of the insulation material 28 to cohesively hold the insulation material together, and possibly adhesively affix the insulation material to the wall of the envelope 26, to prevent the insulation material 28 from shifting or settling within the envelope 26. The binding material used is a function of the type of insulation material 28 and can be a thermosetting adhesive, thermoplastic adhesive, cold setting adhesive, ambient setting adhesive, or hot setting adhesive. For example, a suitable adhesive for use with fiberglass and mineral wool is a phenolic or sodium silicate, and a suitable adhesive for cellulose is polyvinyl acetate.

The collar 24 extends circumferentially around the inner water tank 12 in the annular space 16 proximate the bottom end of the water heater device 10. The collar 24 has a width greater than the radial width of the annular space 16 so that the collar 24 is radially compressed between the interior wall surface of the outer shell 14 and the exterior wall surface of the inner water tank 12 to a sufficient degree in order to tightly seal the interface of the collar 24 and inner wall surface of the outer shell 14 and to tightly seal the interface of the collar 24 and exterior wall surface of the inner water tank 12. In addition, the collar 24 is in abutment with the water heater device floor 22.

Figure 2:
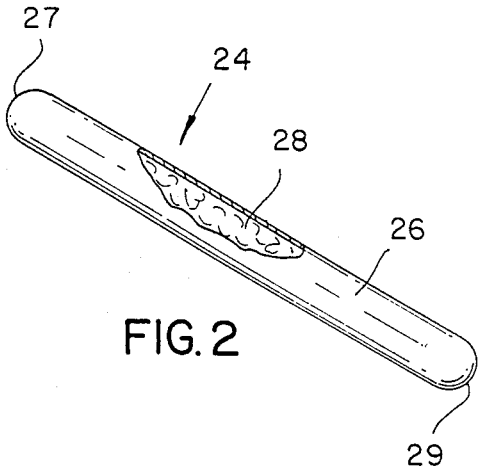
FIG. 2 is a perspective view of a component of the present invention with portions broken away to show internal details.
Figure 6:
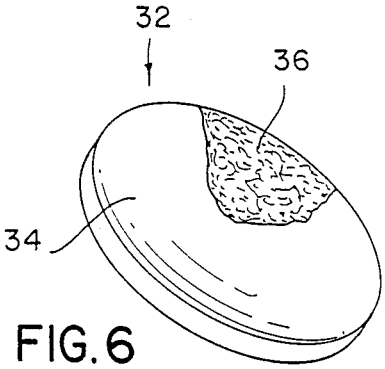
FIG. 6 is a perspective view of another component of the present invention with portions broken away to show internal details.

With reference to FIG. 2, the enclosing envelope 26 of the collar 24 is in the form of an elongated generally cylindrical tube closed at both of its ends 27 and 29. The tubular collar 24 is circumferentially wrapped around the perimeter of the water tank 12 with the ends 27 and 29 thereof brought together into mutual abutment. The abutting ends 27 and 29 can be secured together by, for example, adhesive tape if necessary.

Figure 3:
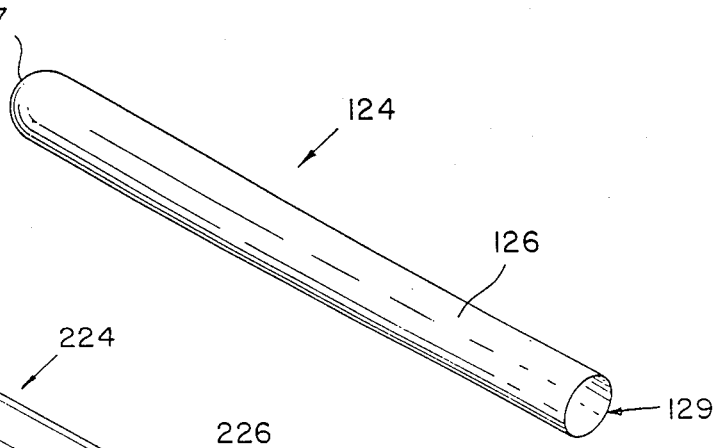
FIG. 3 illustrates an alternative embodiment of the component of FIG. 2.

With reference to FIG. 3, an alternative construction for the enclosing envelope 26 of the collar 24 is illustrated. Envelope 126 is in the form of an elongated generally cylindrical tube having one of its ends 127 closed and the other of its ends 129 open. The tubular collar 124 formed in party by envelope 126 is circumferentially wrapped around the perimeter of the water tank 12 and the closed end 127 is inserted into the open end 129. The ends 127 and 129 can be secured together by, for example, adhesive tape, if necessary.

Figure 4:
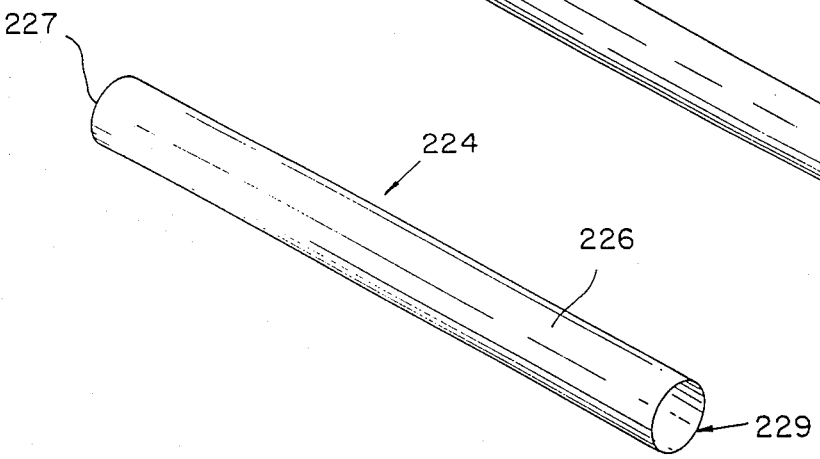
FIG. 4 illustrates an alternative embodiment of the component of FIG. 2.

With reference to FIG. 4, a further alternative construction is illustrated. The enclosing envelope 226 of the collar 224 is in the form of an elongated generally cylindrical tube having both of its ends 227 and 229 open. The tubular collar 224 is circumferentially wrapped around the perimeter of the water tank 12 and one of the open ends 227 is inserted in to the other of the open ends 229. The ends 227 and 229 can be secured together by, for example, adhesive tape, if necessary.

Figure 5:
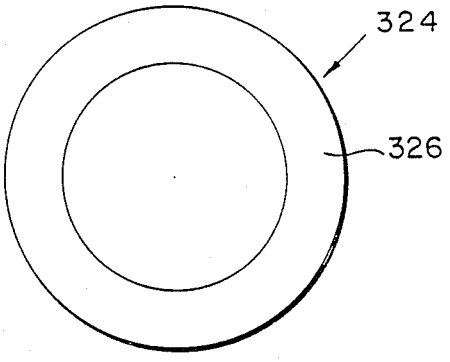
FIG. 5 illustrates an alternative embodiment of the component of FIG. 2.

With reference to FIG. 5, a still further alternative construction is illustrated. The enclosing envelope 326 of the collar 324 is in the form of a closed toroid. The envelope 326 is filled with a suitable insulation material as previously described relative to collar 24. The toroid collar 324 is concentrically slid over the water tank 12.

With reference once again to FIG. 1, the annular space 16 above the collar 24 is filled with an expanded foam thermal insulation material 30 such as urethane, polyethylene, polystyrene and the like, which functions as a thermal insulation surrounding the inner water tank 12.

With reference to FIG. 1, an insulating disc 32 is located at the bottom end of the inner water tank 12. The insulating disc 32 includes an enclosing envelope 34 filled with a thermal insulation material 36. The enclosing envelope 34 has a peripheral configuration matching that of the bottom end of the water heater 12 and a thickness preferably at least as great as the depth of the concavity 18. As shown, the envelope 34 has a generally circular perimeter to correspond to the perimeter of the bottom end of the inner water tank 12 so that the disc 34 overlays the bottom end of the tank. The enclosing envelope 34 is fabricated of a fluid-impermeable, pliable material such as, for example, polyethylene film, vinyl film, metalized polyester, metal foil, and the like. The thermal insulation material 36 is either a fibrous batt such as interwoven fiberglass, or a loose, discrete, divided material such as, for example, noninterengaged fiberglass, steel wool, mineral wool, cellulose fibers, ceramic fibers, discrete particles or beads of plastic foam, and the like. It is contemplated that in some applications it may be necessary to cohesively hold the loose, discrete, divided insulation material together inside the envelope 34, and possibly adhesively affix the insulation material to the wall of the envelope 34, to prevent the insulation material from shifting or settling within the enclosing envelope 34. In this event, a binder material is homogeneously dispersed throughout the mass of insulation material 36 to cohesively hold the insulation material together and prevent the insulation material from shifting or settling within the envelope 34. The binder material used will be a function of the type of insulation material 36 and can be a thermosetting adhesive, thermoplastic adhesive, cold setting adhesive, ambient setting adhesive, or hot setting adhesive. For example, a suitable adhesive for use with fiberglass and mineral wool is phenolic or sodium silicate, and a suitable adhesive for cellulose is polyvinyl acetate.

Figure 7:
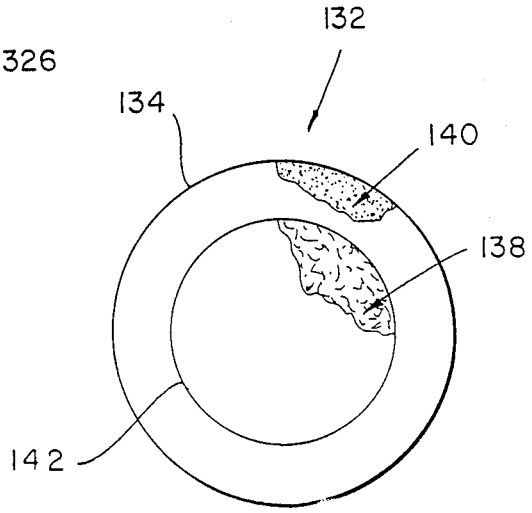
FIG. 7 illustrates an alternative embodiment of the component of FIG. 6.

With reference to FIG. 7, an alternative construction for disc 32 is illustrated. The insulating disc 132 includes an enclosing envelope 134 having a peripheral configuration generally matching that of the bottom end of the water tank and a thickness preferably at least as great as the depth of the cavity 18. The envelope 134 includes a central inner circular pocket 138 concentrically surrounded by a perimeter outer pocket 140. The envelope 134 is fabricated of a fluid-impermeable, pliable material such as, for example, polyethylene film, vinyl film, metalized polyester, metal foil and the like. The central circular pocket 138 is separated from the perimeter pocket 140 by a circular seal 142. The central circular pocket 138 is filled with a fibrous batt of insulation material, such as interwoven or interengaged fiberglass, and the perimeter pocket 140 is filled with a loose, discrete, divided insulation material such as, for example, noninterengaged fiberglass, mineral wool, steel wool, cellulose fibers, ceramic fibers, discrete particles of beads of plastic foam, and the like. However, it is contemplated that the central circular packet 138 be filled with the loose, discrete, divided insulation material and the perimeter pocket 140 be filled with the fibrous batt. It is contemplated that in some applications, it may be necessary to cohesively hold the loose, discrete, divided insulation together inside of the pocket. In this event, a binder material is homogeneously dispersed throughout the mass of insulation material within the pocket to cohesively hold the insulation material together, and possibly adhesively affix the insulation material to the wall of the pocket to prevent the insulation material from shifting or settling within the pocket. The binder material used will be a function of the type of insulation material used within the pocket and can be thermosetting adhesive, thermoplastic adhesive, cold setting adhesive, ambient setting adhesive, or hot setting adhesive. For example, a suitable adhesive for use with fiberglass and mineral wool is phenolic or sodium silicate, and a suitable adhesive for cellulose is polyvinyl acetate.

Figure 8:
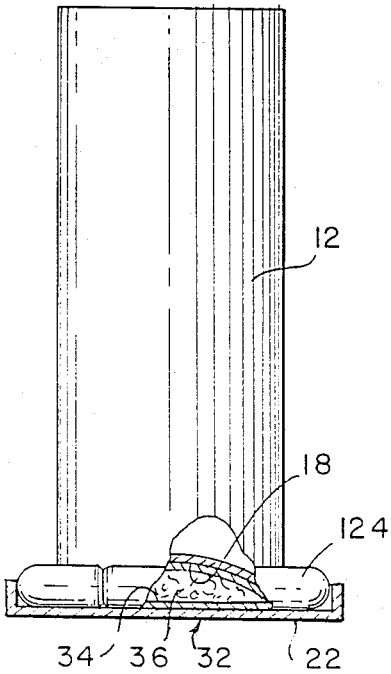
FIG. 8 is a schematic representation illustrating steps of the manufacture of the water heater device of FIG. 1.
Figure 9:
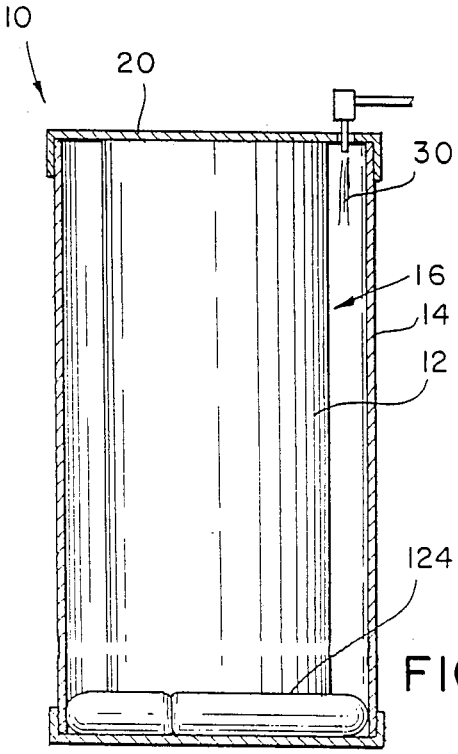
FIG. 9 is a schematic representation illustrating further steps of the manufacture of the water heater device of FIG. 1.

With reference to FIGS. 8 and 9, there is illustrated, in schematic format, the results of various steps for manufacturing the water heater 10. The insulation collar 124 (or one or the alternative constructions) is circumferentially fitted around the perimeter of the inner water tank 12 proximate the bottom end thereof. The collar 124 can be secured to the wall of the water tank 12 by an adhesive, or tape. The insulating disc 32 (or one of the alternative constructions) is disposed in overlaying relationship to the bottom end of the water tank 12, and can be secured in place by an adhesive or a tape. The outer shell 14 is coaxially moved over the inner water tank 12, the floor 22 is positioned over the bottom of the water tank 12 and the outer shell 14 assembly to close the bottom of the water heater device 101. An expandable foam insulation material 30 is injected into the annular space 16 between the inner water tank 12 and outer shell 14 above the collar 124 and allowed to expand in situ filling the annular space 16 above the collar 124. The collar 124 is radially compressed between the inner wall surface of the outer shell 14 and outer wall surface of the inner water tank 12 to form a seal at the interface of the collar 124 and outer shell 14 and a seal at the interface of the collar 124 and inner water tank 12, and functions as a stop or block to the expanding foam.

Figure 10:
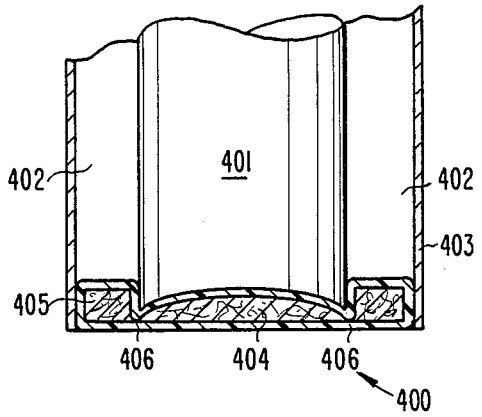
FIG. 10 is a partial, front elevational view in full section of a water heater according to one embodiment of the present invention.

With reference to FIG. 10, there is illustrated another embodiment of the invention wherein insulating member 400 is disposed beneath tank 401 and around the lower periphery of the tank in the annular space 402 which is defined by the tank and shell 403. Although member 400 begins as a single, generally cylindrical envelope which is filled with insulation material, it is ultimately configured into the shape and arrangement of FIG. 8. One way to view member 400 (see FIG. 11) is to see it as comprising a center pouch 404 which is disc-shaped and disposed beneath the tank and a surrounding annular ring pouch 405 which fits snugly between the outer surface of the tank and the inner surface of the shell.

The circular line of intersection 406 between center pouch 404 and annular ring pouch 405 may be heat sealed closed (as in FIG. 7) or left open such that there is communication between the two pouches. By sealing the interface between the two pouches different insulating materials can be placed in the two pouches. If sealing is to be done, it must be performed before the tank is positioned over member 400 and thus the circumferential size of the tank must be considered in order to properly size the two pouches. It is also important that the radial width of the annular ring pouch be greater than the width of the clearance space so that enough compression of the pouch can be obtained in order to establish the desired seal between the tank and the shell.

The two pouches 404 and 405 are constructed of a flexible, fluid-impermeable material which is sufficiently pliable to conform to the desired shapes. This pliable material envelope may be the same as any of the material options given for envelope 26. Each pouch envelope is filled with an insulation material which may be the same as any of the material options given for insulation material 28.

Figure 12:
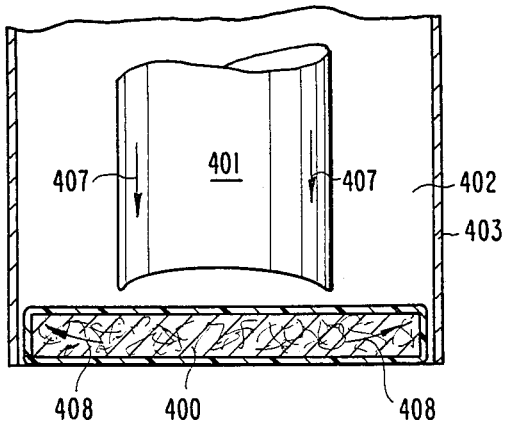
FIG. 12 is a partial front elevational view, in full section, of an alternative embodiment of the present invention.

If the insulating member 400 is not preshaped and configured and heat sealed along the line of intersection 406, then it begins as a single envelope of a generally cylindrical shape, see FIG. 12. Member 400 is initially placed within the shell 403 at its base and is centered as much as possible within the shell. A tight fit initially is not required because as the tank 401 is lowered onto the insulating member (arrows 407), the weight of the tank causes the center of the member to compress and conform to the contour of the bottom of the tank. As this occurs, some of the insulation pushes outwardly (arrows 408) shaping and orienting member 400 into the form illustrated in FIG. 10. The shift in the insulation and the pliable shaping of the enclosing envelope into the FIG. 10 form creates the annular ring pouch 405 in the form of a collar which seals off the space 402.

Figure 11:
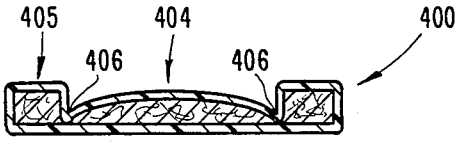
FIG. 11 is a front elevational view of an insulation-filled pouch comprising a portion of the FIG. 10 water heater.

As a further variation to the construction member 400, it is possible to mold the entire envelope into the shape illustrated in FIG. 11 prior to filling the envelope with insulation material. The envelope is then filled with a sufficient amount of insulation material in order to support the walls of the envelope and in order to maintain the desired shape. The molded configuration of the envelope is sized and shaped according to the size and contour of the tank 401 and the annular clearance space 402.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A water heater device comprising:

(a) a water tank;

(b) an outer shell concentrically located over the water tank defining an annular clearance space therebetween; and (c) a thermal insulating member including a pliable material envelope which is filled with loose, discrete insulation material, said envelope being arranged into a disc-shaped portion disposed beneath the bottom end of the water tank and connected thereto an annular collar portion disposed around said water tank and positioned within said annular clearance space, said collar having a radial thickness greater than the radial width of said annular clearance space such that the collar is radially compressed between the shell and tank.

* * * * *